US009000982B2

(12) United States Patent
Chethik et al.

(10) Patent No.: US 9,000,982 B2
(45) Date of Patent: Apr. 7, 2015

(54) CONFORMAL ARRAY ANTENNA

(75) Inventors: Frank Chethik, El Granada, CA (US); Richard D. Breen, Jr., Fremont, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 538 days.

(21) Appl. No.: 13/416,738

(22) Filed: Mar. 9, 2012

(65) Prior Publication Data

US 2013/0234890 A1 Sep. 12, 2013

(51) Int. Cl.

| | |
|---|---|
| ***H01Q 3/12*** | (2006.01) |
| ***H01Q 3/26*** | (2006.01) |
| ***H01Q 3/36*** | (2006.01) |
| ***H01Q 21/06*** | (2006.01) |

(52) U.S. Cl.
CPC ..... *H01Q 3/267* (2013.01); *H01Q 3/36* (2013.01); *H01Q 21/06* (2013.01)

(58) Field of Classification Search
USPC ..... 342/374, 447, 448, 361
See application file for complete search history.

(56) References Cited

U.S. PATENT DOCUMENTS 5,457,465 A * 10/1995 Collier et al. ..... 342/374
6,961,025 B1 11/2005 Chethik et al.
8,305,265 B2 * 11/2012 Ezal et al. ..... 342/357.36

OTHER PUBLICATIONS

Chethik, F. et al, "A Low Cost Conformal Switched Array Antenna," IEEE, 2010.
Chethik, F. et al., "Slide Presentation: A Low Cost Conformal Switched Array Antenna," Prepared for the IEEE URSI/APS Conference, Jul. 15, 2010.

* cited by examiner

*Primary Examiner* — Harry Liu
(74) *Attorney, Agent, or Firm* — Oblon, McClelland, Maier & Neustadt, L.L.P.

(57) ABSTRACT

Aspects of the disclosure provide an antenna array system. The antenna array system includes a plurality of antenna elements and phase-shift switching circuitry. The plurality of antenna elements are organized in an array and configured to form a non-planar shaped antenna array surface. Each of the plurality of antenna elements is switchable to one of a plurality of phase shift states. The phase-shift switching circuitry is configured to switch each of the plurality of antenna elements to one of the plurality of phase shift states based on phase control signals. In an example, the phase-shift switching circuitry switches a first set of antenna elements to a first phase shift state and switches at least a second set of antenna elements to a second phase shift state to steer an antenna beam in a direction.

20 Claims, 5 Drawing Sheets

CONFORMAL ARRAY ANTENNA

BACKGROUND

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

It is often desirable to have an antenna that is "steerable," so that the antenna can be used to communicate while the antenna is attached to a moving object. Further, it would be advantageous to have an antenna with increased aperture size, gain and field of regard.

SUMMARY

Aspects of the disclosure provide an antenna array system. The antenna array system includes a plurality of antenna elements and phase-shift switching circuitry. The plurality of antenna elements are organized in an array and configured to form a non-planar shaped antenna array surface. Each of the plurality of antenna elements is switchable to one of a plurality of phase shift states. The phase-shift switching circuitry is configured to switch each of the plurality of antenna elements to one of the plurality of phase shift states based on phase control signals. In an example, the phase-shift switching circuitry switches a first set of antenna elements to a first phase shift state and switches at least a second set of antenna elements to a second phase shift state to steer an antenna beam in a direction.

In an embodiment, each of the plurality of antenna elements is switchable to one of 0° phase shift state, 90° phase shift state, 180° phase shift state and 270° phase shift state.

In addition, in an example, the antenna array system also includes antenna switching circuitry configured to switch on or off each of the plurality of antenna elements based on antenna control signals.

According to an aspect of the disclosure, each of the antenna elements includes at least two beam former components that are individually switchable to the plurality of phase shift states.

It is noted that the antenna array can be a transmit antenna array, a receive antenna array, or a transmit and receive antenna array. In an embodiment, the first set of antenna elements forms a hexagonal array.

It is also noted that the phase-shift switching circuitry can use transistor switches and/or MEM switches to switch each of the plurality of antenna elements to one of the plurality of phase shift states based on the phase control signals.

According to an aspect of the disclosure, the antenna array system can be installed on any suitable vehicle, such as ground vehicle, air-borne vehicle, space vehicle, water vehicle, satellite stations, and the like.

Aspects of the disclosure provide a method. The method includes receiving phase control signals for a plurality of antenna elements organized in an array and configured to form a non-planar shaped antenna array surface, each of the phase control signals being indicative of one of a plurality of phase shift states, and switching, according to the phase control signals, a first set of antenna elements to a first phase shift state of the plurality of phase shift states and at least a second set of antenna elements to a second phase shift state of the plurality of phase shift state to steer an antenna beam to a direction.

BRIEF DESCRIPTION OF THE DRAWINGS

Various embodiments of this disclosure that are proposed as examples will be described in detail with reference to the following figures, wherein like numerals reference like elements, and wherein.

DETAILED DESCRIPTION OF EMBODIMENTS

Figure 1:
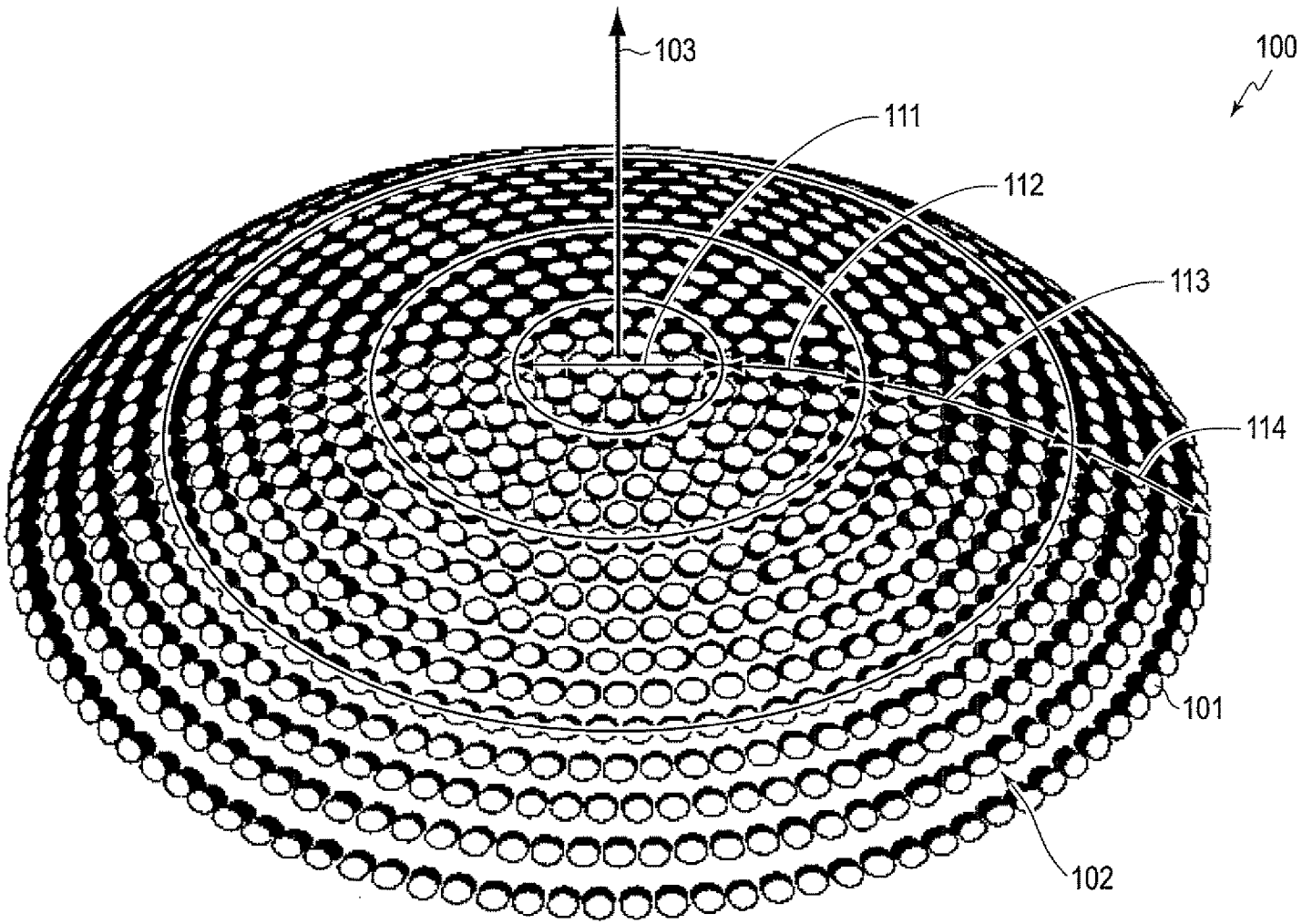
FIG. 1 shows a plot of an antenna array system example 100 according to an embodiment of the disclosure.

FIG. 1 shows a plot of an antenna array system example 100 according to an embodiment of the disclosure. The antenna array system 100 includes a plurality of antenna elements 101 organized in an array and configured to form a non-planar shaped antenna array surface 102. The antenna elements 101 may include any suitable antenna elements, such as horn antenna elements, patch antenna elements, dipole antenna elements, helical antenna elements, slot antenna elements, or any other suitable antenna element configuration. For example, the antenna elements 101 may include horn antenna elements, such as cylindrical horn antenna elements, conical horn antenna elements, or step-cylinder horn antenna elements. Alternatively, rectangular or pyramidal horn antenna elements may be used.

The antenna elements 101 may be symmetrically located within the antenna array system 100 or they may have a non-symmetrical configuration. Further, the antenna elements 101 may be evenly or unevenly spaced within the antenna array system 100, and the antenna elements 101 may all be the same size, or the antenna array system 100 may include a plurality of different sized antenna elements 101. Also, the shape of the antenna array system 100 is non-planar and may include any suitable shape configuration, such as a spherical convex shape, a spherical concave shape, a parabolic convex shape, a parabolic concave shape, an ellipsoidal convex shape, an ellipsoidal concave shape, a saddle shape, an air-foil shape, or any other shape that has a region where a plane tangent to that region is perpendicular to a desired direction of radiation.

In the FIG. 1 example, the antenna array system 100 includes a convex spherical shaped array, having symmetrically oriented and evenly spaced antenna elements 101. In this embodiment, the antenna elements 101 are organized in a hexagonal configuration, and all antenna elements 101 are the same size. Because the antenna array system 100 is shaped, the antenna beam may be pointed at a directional angle not necessarily perpendicular to the center of the antenna array system 100.

According to an aspect of the disclosure, each antenna element 101 is switchable to one of a plurality of predetermined phase shift states. When the antenna element 101 is switched to a phase shift state, a predetermined phase shift is added in a signal path electrically coupled with the antenna element 101. Further, in an embodiment, the antenna array system 100 includes a controller (not shown) that determines phase shift states for the antenna elements 101, such that the antenna elements 101 collectively contribute to a beam with a desired beam direction. Thus, in an example, because all the antenna elements 101 contribute to the beam, the antenna array system 100 has an increased gain, increased aperture size, and increased field of regard.

In an example, each antenna element 101 is switchable to one of a first phase shift state, a second phase shift state, a third phase shift state and a fourth phase shift state. When an antenna element 101 is switched to the first phase shift state, zero degree phase shift is added into a signal path coupled with the antenna element 101; when an antenna element 101 is switched to the second phase shift state, −90° phase shift is added into a signal path coupled with the antenna element 101; when an antenna element 101 is switched to the third phase shift state, −180° phase shift is added into a signal path coupled with the antenna element 101; and when an antenna element 101 is switched to the fourth phase shift state, −270° phase shift is added into a signal path coupled with the antenna element 101.

Further, in an example, the antenna elements 101 are suitably switched into the four phase shift states to limit phase errors in a range of (−45°,+45°). Specifically, the antenna elements 101 are grouped into a first set 111, a second set 112, a third set 113 and a fourth set 114 according to phase errors with regard to a reference phase before adding phase shifts. The first set has phase errors modulo 360° in a range of (−45°,+45°), the second set has phase errors modulo 360° in a range of (45°, 135°), the third set has phase errors modulo 360° in a range of (135', 225°), and the fourth set has phase errors modulo 360° in a range of (225°, 315').

Then, the first set is switched into the first phase shift state. The second set is switched into the second phase shift state to add −90° phase shift in the signal paths that are respectively coupled with the second set of antenna elements 101, such that the phase errors on the signal paths after adding the phase shift are in the range of (−45°,+45°). The third set is switched into the third phase shift state to add −180° phase shift in the signal paths, such that the phase errors on the signal paths after adding the phase shift are in the range of (−45°,+45°). The fourth set is switched into the fourth phase shift state to add −270° phase shift in the signal paths, such that the phase errors on the signal paths after adding the phase shift are in the range of) (−45°,+45°). It is noted that the phase shifts for the four phase shift states can be suitably adjusted. In an example, 0', 270', 180° and 90° are the phase shifts for the first phase shift state, the second phase shift state, the third phase shift state and the fourth phase shift state respectively.

In the FIG. 1 example, the first, second, third and fourth sets 111-114 of antenna elements collectively contribute to a beam with a beam direction 103 that is perpendicular to the aperture of the center antenna element of the first set 111. It is noted that the first, second, third and fourth sets 111-114 of antenna elements can be suitably selected to form a beam of any suitable forward pointing beam direction. For example, when the selected first set 111 of the antenna elements 101 is not at the center of the antenna array system 100, the direction of the beam is not perpendicular to the center of the antenna array system 100.

Figure 2:
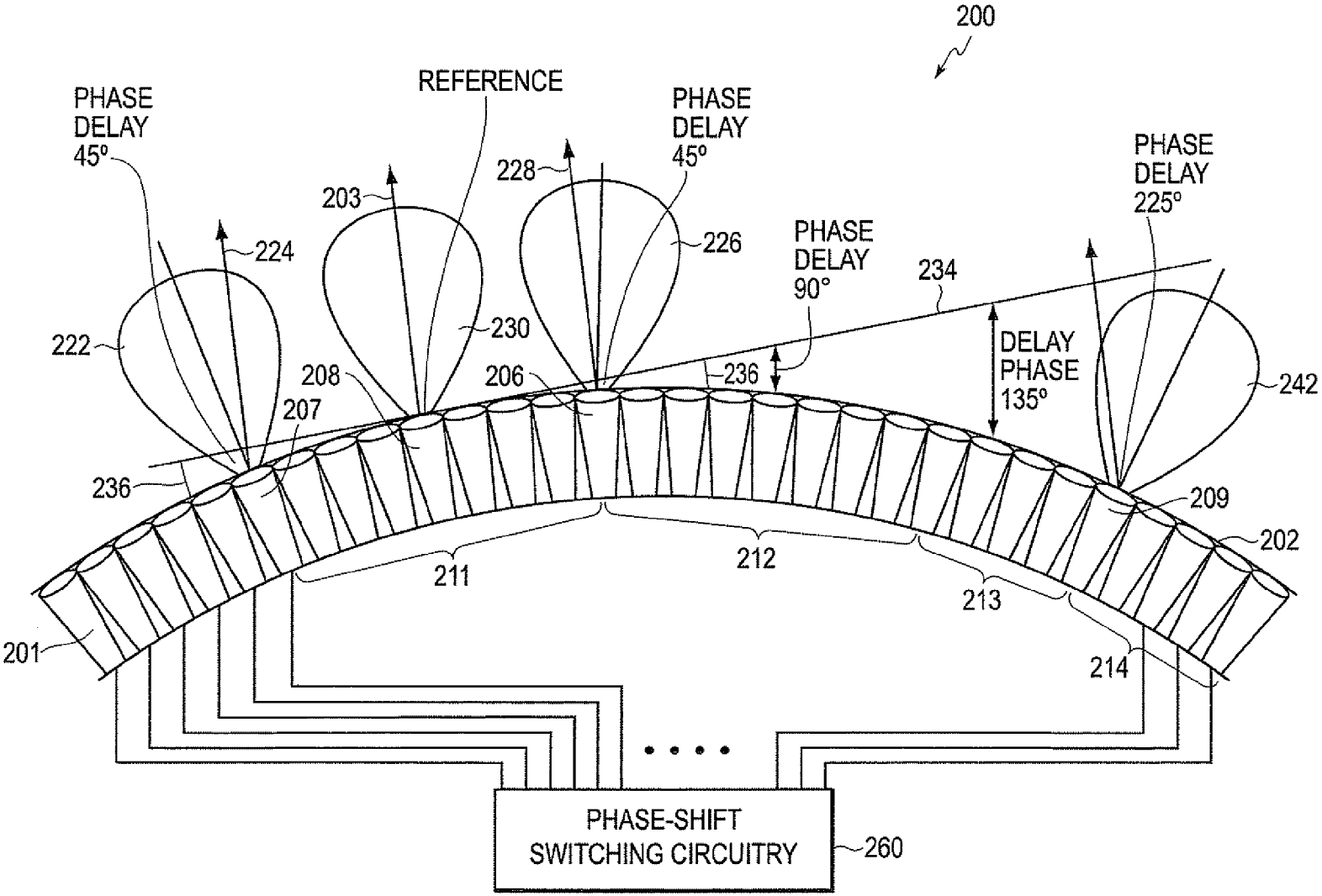
FIG. 2 shows a diagram of an antenna array system example 200 according to an embodiment of the disclosure.

FIG. 2 shows a cross-sectional view of an antenna array system example 200 according to an embodiment of the disclosure. The antenna array system 200 includes a shaped surface 202, a plurality of antenna elements 201, and a phase-shift switching circuitry 260. The shaped surface 202 can be any suitable shaped surface, such as a spherical convex shape, a spherical concave shape, a parabolic convex shape, a parabolic concave shape, an ellipsoidal convex shape, an ellipsoidal concave shape, a saddle shape, an air-foil shape, or any other shape that has a region where a plane tangent to that region is perpendicular to a desired direction of radiation. The antenna elements 201 may include any antenna element type, such as horn antenna elements, patch antenna elements, dipole antenna elements, helical antenna elements, slot antenna elements, or any other suitable antenna element configuration. Further, the phase-shift switching circuitry 260 may include any suitable switching device, such as transistor switches, microelectromechanical (MEM) devices, and the like. In the FIG. 2 example, the shaped surface 202 includes a convex spherical surface and the antenna elements 201 include horn elements.

In an embodiment, to point a beam in a particular beam direction with maximum gain, all the antenna elements 201 are enabled. In another embodiment, a number of antenna elements 201 are selected and enabled. A switch matrix to select and enable a number of antenna elements is disclosure in U.S. Pat. No. 6,961,025, which is incorporated herein by reference in its entirety.

One issue with using a shaped array surface, however, is that the shape will cause phase differences between the elements. For example, as in FIG. 2, assume the desired direction of the antenna beam is along arrow 203. In this case, antenna element 208 (the "reference antenna element") will produce a gain pattern or radiation pattern 230 that has a main lobe axis in the desired beam direction 203. Other antenna elements also will have radiation patterns, which can contribute to the beam gain in the desired direction, but because of the shape of the array, phase differences caused by the contour of the antenna surface will limit the cluster size that may produce a useful antenna beam shape.

The phase differences are caused by the location of the antenna elements 201 with respect to that reference antenna element 208 that has the radiation pattern in the desired direction. For example, the reference antenna element 208 points its beam 203 perpendicular to its aperture. Because of the shape of the array, other antenna elements 201 do not point in the same direction, and in addition, their signal phases are not aligned with the signal from the reference antenna element 208. In most instances, the phase delay (or phase error) is greater for elements further away from the reference element 208 and is a function of the angle 236 between plane 234 and the surface of the array 202. Because of the phase delay, there is a loss of coherence between the signal from the reference element 208 and all other antenna elements in the antenna array system 200.

It is noted that phase delayed signals will have components that can add to the overall signal, but at a certain phase delay, will also subtract or cancel from the overall signal. For example, an antenna element 207 has a radiation pattern 222, which includes a contributing gain component 224 in the desired beam direction 203. The contribution gain component has a phase delay (modulo 360°) of +45° with regard to the reference antenna element 208, and thus the antenna element 207 can contribute to the overall signal. Similarly, an antenna element 206 has a radiation pattern 226, which includes a contributing gain component 228 in the desired beam direction 203. The contribution gain component 228 has a phase delay (modulo 360°) of +45° with regard to the reference antenna element 208, and thus the antenna element 206 can contribute to the overall signal. In this example, all the antenna elements between elements 206 and 207 also contribute to the overall signal.

However, when an antenna element has about 180° phase delay to the reference antenna element 208, the antenna element can subtract or cancel from the overall signal.

Thus, according to an embodiment of the disclosure, the phase-shift switching circuitry 260 includes respective phase-shift switches (not shown) on signal paths coupled to the antenna elements 201. Each phase-shift switch is switchable to one of a plurality of phase-shift states. In each phase shift state, a pre-determined phase shift is added in the coupled signal path. By suitably controlling the phase-shift switches, the phase-shifted signals can add to the overall signal without subtracting or canceling the signal.

In an example, the phase-shift switches are switchable to one of a first phase-shift state, a second phase shift state, a third phase shift state, and a fourth phase shift state. When an antenna element 201 is switched to the first phase shift state, zero degree phase shift is added into a signal path coupled with the antenna element 201; when an antenna element 201 is switched to the second phase shift state, −90° phase shift is added into a signal path coupled with the antenna element 201; when an antenna element 201 is switched to the third phase shift state, −180° phase shift is added into a signal path coupled with the antenna element 201; and when an antenna element 201 is switched to the fourth phase shift state, −270° phase shift is added into a signal path coupled with the antenna element 201.

According to an aspect of the disclosure, before adding phase shifts, phase delays of the antenna elements 201 with regard to the reference antenna elements 208 can be determined based on the shape of the surface, a distance of antenna element 201 from the reference antenna element 208, and a beam frequency (or a beam wavelength). In an example, an algorithm, or an equation can be used to calculate the phase delay of an antenna element 201 as a function of the shape of the surface, a distance of the antenna element 201 from the reference antenna element 208, and the beam frequency. Then, the phase delays modulo 360° are grouped into a first set 211, a second set 212, a third set 213 and a fourth set 214. The first set has phase delays modulo 360° in a range of (−45°,+45°), the second set has phase delays modulo 360° in a range of (45°, 135°), the third set has phase delays modulo 360° in a range of (135°, 225°), and the fourth set has phase delays modulo 360° in a range of (225°, 315°).

Then, the phase-shift switches coupled with the first set are switched into the first phase shift state. The phase-shift switches associated with the second set are switched into the second phase shift state to add −90° phase shift in the signal paths, such that the phase delays on the signal paths are in the range of (−45°,+45'). The phase-shift switches associated with the third set are switched into the third phase shift state to add −180° phase shift in the signal paths, such that the phase delays on the signal paths are in the range of (−45°,+45°). The phase-shift switches associated with the fourth set are switched into the fourth phase shift state to add −270° phase shift in the signal paths, such that the phase delays on the signal paths are in the range of (−45°,+45°).

Thus, all the antenna elements 201 contribute to the overall signal in the beam direction 203. Because all the antenna elements 201 contribute to the beam, the antenna array system 200 has an increased gain, increased aperture size, and increased field of regard.

Figure 3:
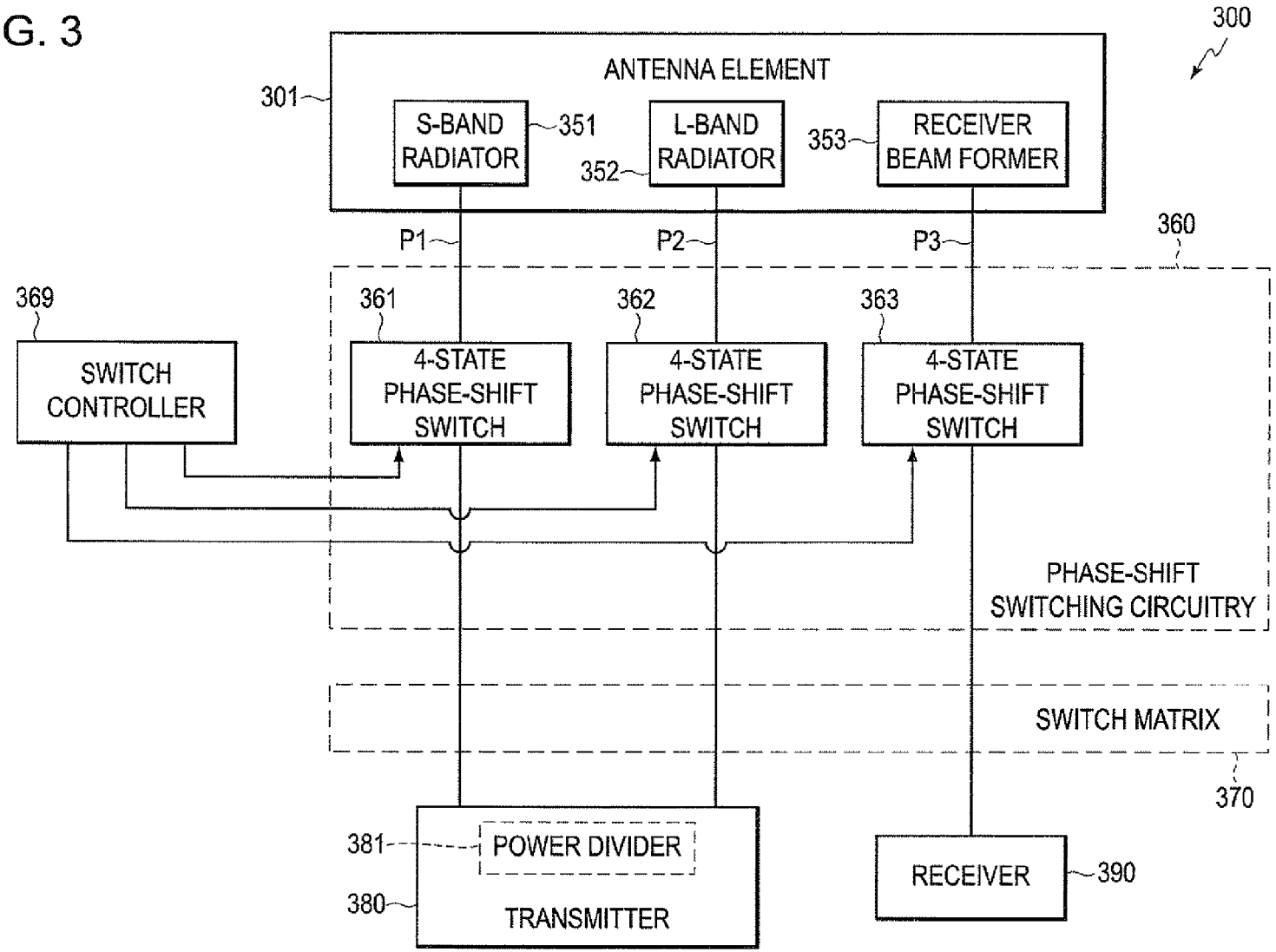
FIG. 3 shows a block diagram of an antenna array system example 300 according to an embodiment of the disclosure.

FIG. 3 shows a block diagram of antenna array system example 300 according to an embodiment of the disclosure. The antenna array system 300 includes a plurality of antenna elements 301, a phase-shift switching circuitry 360, a switch controller 369, a transmitter 380, and a receiver 390. These elements are coupled together as shown in FIG. 3.

Each antenna element 301 includes a plurality of beam formers, such as an S-band radiator 351, an L-band radiator 352, a receiver beam former 353, and the like. In an example, antenna element is configured as a horn element that covers S-band and L-band frequencies. Further, the horn element includes built-in cross-polarized mode launchers to separate L-band and S-band. In another example, an antenna element is configured as dipole patch that includes separate dipoles for S-band and L-band. The dipoles are within a common aperture. The antenna element uses native pass-band frequency separation to separate S-band with L-band. In another example, an antenna element is configured as Archimedean spiral element that provides L-band S-band separation.

Further, the antenna array system 300 includes signal paths, such as P1-P3 that are respectively coupled to the plurality of beam formers. Each of the signal paths P1-P3 includes any suitable signal processing components, such as switch, amplifier, and the like to process the signal to the coupled beam former or from the coupled beam former. Thus, the plurality of beam formers can operate independently. Thus, all the antenna elements 301 can simultaneously form a plurality of beams, such as a receiving beam and a transmitting beam, beams of different frequencies, beams of different beam directions, and the like.

For each antenna element 301, the phase-shift switching circuitry 360 includes phase-shift switches 361-363 on the signal paths P1-P3. Each of the phase-shift switches 361-363 can operate independently. It is noted that the phase-shift switches 361-363 can have a same configuration, such as including four phase-shift states as shown in FIG. 3, or can have different configurations, such as having different number of phase-shift states. In an embodiment, switches are configured differently for transmitting beam former and receiving beam former. Switches for the receiving beam former are implemented using DC bias switches on low noise amplifiers (LNAs). Switches for the transmitting beam former are configured to operate at relatively high RF power level. Any suitable technology, such as transistor switching device, MEM switching device, and the like, can be used to implement the phase-shift switching circuitry 360.

The transmitter 380 includes any suitable components to generate signals for transmitting, and drive the generated signals to the beam formers for transmitting. In an example, the transmitter 380 includes a power divider 381 configured to divide an input power into a plurality of portions. The plurality of portions is respectively provided to a plurality of the antenna elements 301 for transmitting.

The receiver 390 includes any suitable components to receive signals from the beam formers for receiving, and process the received signals.

The switch controller 369 generates phase-shift control signals to control the phase-shift switches 361-363. The switch controller 369 can be implemented using any suitable technique, such as a micro-processor, field programmable gate array (FPGA), application specific integrated circuit (ASIC), and the like.

In an embodiment, the antenna array system 300 includes a switch matrix 370 configured to selectively switch on or switch off an antenna element 301. In another embodiment, the switch matrix 370 is not needed.

Figure 4:
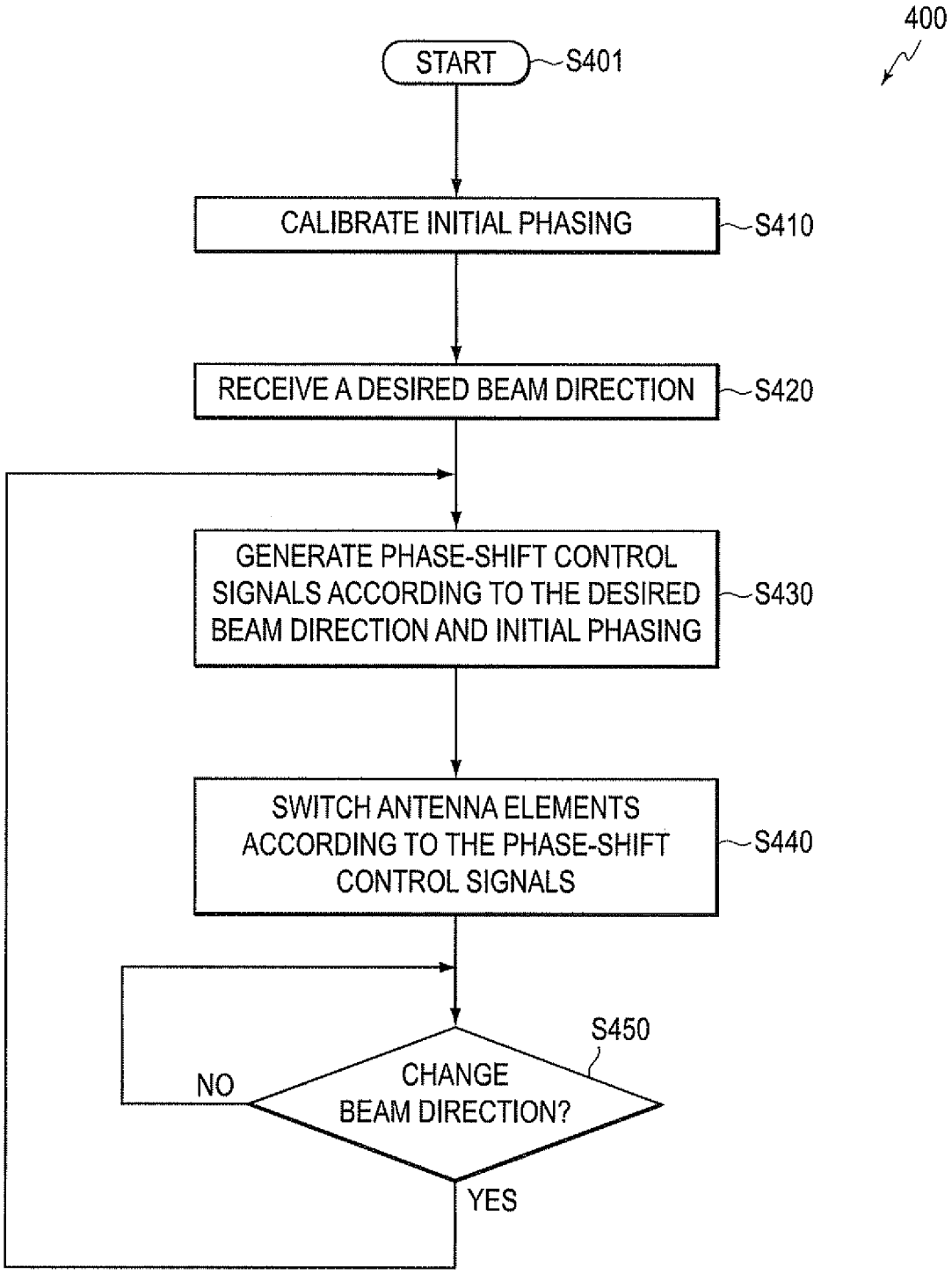
FIG. 4 shows a flow chart outlining a process example 400 according to an embodiment of the disclosure.

FIG. 4 shows a flow chart outlining a process example 400 for an antenna array system, such as the antenna array systems 100, 200 and 300, to form a beam of a desired beam direction according to an embodiment of the disclosure. The process starts at S401, and proceeds to S410.

At S410, a calibration procedure is performed. In an embodiment, the calibration procedure determines an initial phasing for each signal path. The initial phasing is affected by parasitic phase shift, such as phase shift due to manufacturing variations, installation variations, environmental parameter changes, and the like. The initial phasing can be used to compensate for the manufacturing variations, installation variations, environmental parameter changes, and the like. The calibration procedure can be performed at factory or at field set-up, and can be performed manually or automatically. Further, the calibration procedure can be performed once, periodically, or in response to a calibration request.

At S420, a switch controller, such as the switch controller 369, receives a desired beam direction for transmitting or receiving signals. The desired beam direction can be determined by a user of the antenna array system, a processor coupled to the antenna system, and the like. In an example, the antenna array system is installed on a vehicle, such as a ground vehicle, air-borne vehicle, space vehicle, water vehicle, satellite stations, and the like. Air vehicles may include, but are not limited to, airplanes, helicopters, balloons, missiles, and endo- and exo-atmospheric platforms. Similarly, water vehicles can include boats and submarines, and ground vehicles can include any form of ground vehicle, such as cars, trucks, tanks, fighting vehicles or the like.

The antenna array system is in communication with another antenna system. The other antenna system can be a location fixed antenna system or can be a moving antenna system. In an example, the vehicle also includes a sensor that senses the geographic information of the vehicle, such as location information, direction information, and the like. Based on the geographic information of the vehicle, a processor adjusts the desired beam direction for communication with the other antenna system. In another example, the sensor is configured to receive signals from the other antenna system from a plurality of directions, and the processor is configured to select one of the directions that has the maximum signal strength as the desired beam direction.

At S430, the switch controller generates phase-shift control signals according to the desired beam direction and the calibrated initial phasing. The switch controller can use any suitable technical, such as look-up table, algorithm, algebra calculation, and the like, to generate the phase-shift control signals. It is noted that, in an example, a phase-shift control signal for an antenna element is generated based on the initial phasing of the antenna element, surface shape of the antenna array system, distance from the antenna element to a reference antenna element aligned in the desired beam direction.

In an example, a phase-shift control signal is indicative of configuring an antenna element into one of a plurality of phase-shift states to add a predetermined phase shift into a signal path coupled to the antenna element. For example, each antenna element is switchable to one of a first phase-shift state, a second phase shift state, a third phase shift state, and a fourth phase shift state. When an antenna element is switched to the first phase shift state, zero degree phase shift is added into a signal path coupled with the antenna element; when an antenna element is switched to the second phase shift state, −90° phase shift is added into a signal path coupled with the antenna element; when an antenna element is switched to the third phase shift state, −180° phase shift is added into a signal path coupled with the antenna element; and when an antenna element is switched to the fourth phase shift state, −270° phase shift is added into a signal path coupled with the antenna element.

In an embodiment, before adding phase shifts in the signal paths, the reference antenna element has a main lobe axis in the desired beam direction, and other antenna elements either have a component to add to the signal in the desired beam direction or subtract the signal in the desired direction. The phase-shift control signals can be generated in a manner that after adding phase shifts according to the phase-shift control signals, substantially all the antenna elements have a component to add to the signal in the desired beam direction.

At S440, antenna elements are respectively switched into one of the plurality of phase-shift states according to the phase-shift control signals. In an embodiment, the antenna array system includes a phase shift switching circuitry that includes a phase-shift switch on each signal path. The phase-shift switch includes four states that respectively add predetermined phase shifts, such as zero, −90°, −180° and −270° in to the signal path. The phase-shift control signals control the phase-shift switches to add phase shifts into the signal paths.

At S450, the antenna array system determines whether the beam direction needs to be changed. For example, the switch controller periodically receives the desired beam direction from a processor. When a new desired beam direction is received, the switch controller compares the new desired beam direction with the present desired beam direction. When the new desired beam direction is substantially the same as the present desired beam direction, the process returns to S450; otherwise, the process returns to S430 to update the phase-shift control signals.

Figure 5:
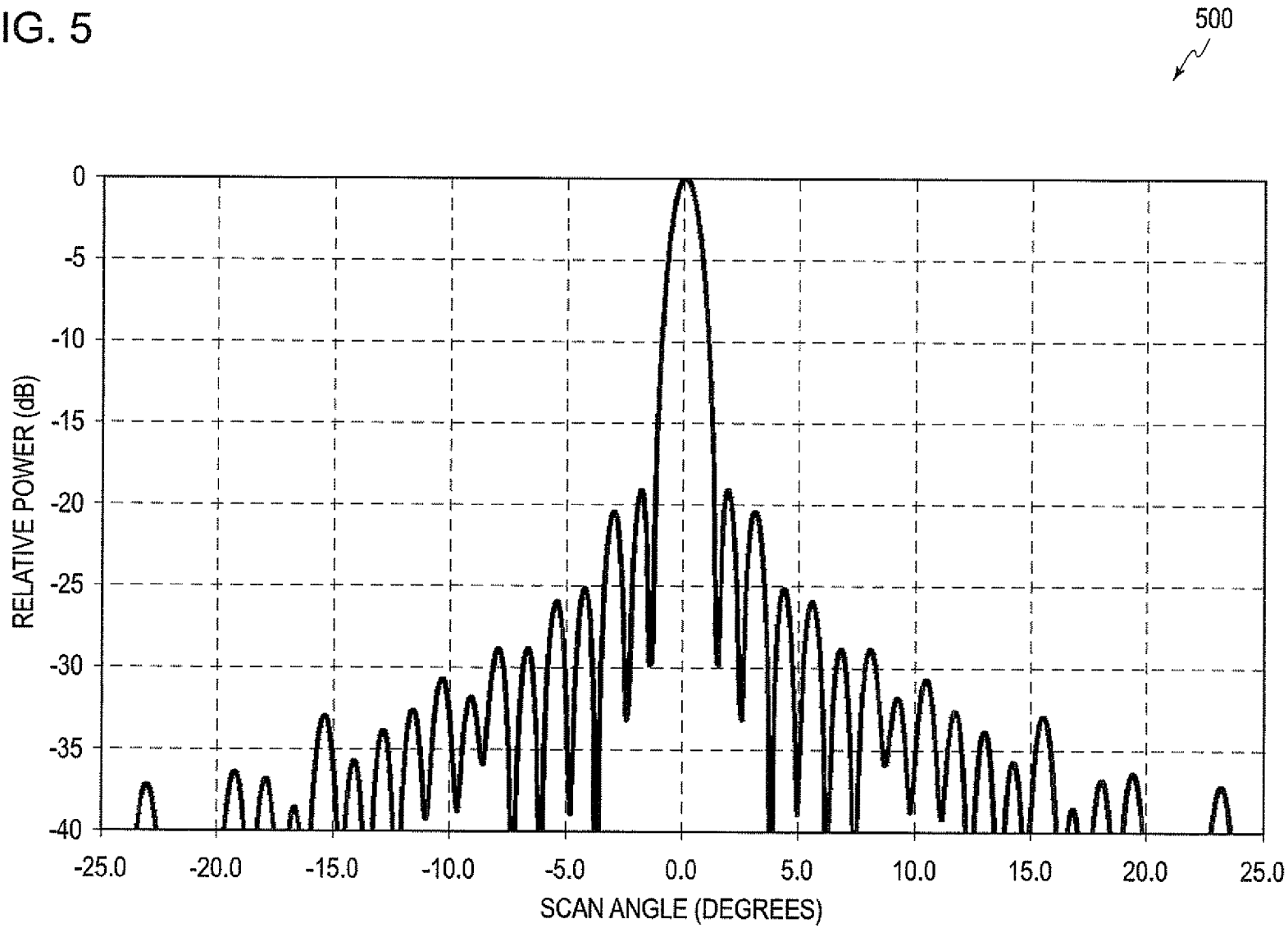
FIG. 5 shows a plot 500 of gain for an antenna array system according to an embodiment of the disclosure.

FIG. 5 shows a plot 500 of directivity for an antenna array system according to an embodiment of the disclosure. The antenna array system is implemented using antenna elements that are switchable to four phase shift states to limit array phase errors in the range of) (−45°,+45°. The antenna array system has a peak directivity of 43 dBi, sidelobe response (−17 dB) and no aliasing beams. The implementation uses a calibration procedure for determining initial phasing and configures the antenna elements into one of four phase shift states based on the calibration and a desired beam direction. The antenna array system can be implemented using relatively simple components, with relatively low manufacturing and maintaining cost.

While the disclosure has been described in conjunction with the specific embodiments thereof that are proposed as examples, it is evident that many alternatives, modifications, and variations will be apparent to those skilled in the art. Accordingly, embodiments of the disclosure as set forth herein are intended to be illustrative, not limiting. There are changes that may be made without departing from the scope of the invention.

What is claimed is:

1. An antenna array system, comprising:

a plurality of antenna elements organized in an array and configured to form a non-planar shaped antenna array surface, each of the plurality of antenna elements being switchable to one of a plurality of phase shift states; and phase-shift switching circuitry configured to switch one set of the antenna elements to one of the phase shift states and switch another set of the antenna elements to another of the phase shift states based on phase control signals for steering an antenna beam to a direction, the one set and another set being one and another of at least four sets of the antenna elements, a first set having a phase delay range of (−45°, +45°), a second set having a phase delay range of (+45°,+135°), a third set having a phase delay range of (+135°,+225°), and a fourth set having a phase delay range of (+225°,+315°).

2. The antenna array system of claim 1, wherein each of the plurality of antenna elements is switchable to one of 0° phase shift state, 90° phase shift state, 180° phase shift state and 270° phase shift state.

3. The antenna array system of claim 1, further comprising:

antenna switching circuitry configured to switch on or off each of the plurality of antenna elements based on antenna control signals.

4. The antenna array system of claim 1, wherein each of the antenna elements includes at least two beam former components that are individually switchable to the plurality of phase shift states.

5. The antenna array system of claim 1, wherein the antenna elements are selected from a group including of cylindrical horn antenna elements, conical horn antenna elements, step-cylinder horn antenna elements, dipole antenna elements, helical antenna elements and slot antenna elements.

6. The antenna array system of claim 1, wherein the non-planar shaped antenna array surface has a non-planar shape selected from a group including of a spherical convex shape, a spherical concave shape, a parabolic convex shape, a parabolic concave shape, an ellipsoidal convex shape, an ellipsoidal concave shape, a saddle shape, and an airfoil shape.

7. The antenna array system of claim 1, wherein the antenna array is a transmit antenna array, a receive antenna array, or a transmit and receive antenna array.

8. The antenna array system of claim 1, wherein the first one set of antenna elements forms a hexagonal array.

9. The antenna array system of claim 1, wherein the phase-shift switching circuitry comprises at least one of transistor switches and MEM switches to switch each of the plurality of antenna elements to one of the plurality of phase shift states based on the phase control signals.

10. A method, comprising:

receiving phase control signals for a plurality of antenna elements organized in an array and configured to form a non-planar shaped antenna array surface, each of the phase control signals being indicative of one of a plurality of phase shift states; and switching, according to the phase control signals, one set of the antenna elements to one of the phase shift states and switching another set of the antenna elements to another of the phase shift states for steering an antenna beam to a direction, the one set and another set being one and another of at least four sets of the antenna elements, a first set having a phase delay range of (−45°,+45°), a second set having a phase delay range of (+45°,+135°), a third set having a phase delay range of (+135°,+225°), and a fourth set having a phase delay range of (+225°,+315°).

11. The method of claim 10, wherein receiving phase control signals for a plurality of antenna elements further comprises:

receiving the phase control signals that are indicative of switching each of the plurality of antenna elements to one of 0° phase shift state, 90° phase shift state, 180° phase shift state and 270° phase shift state.

12. The method of claim 10, further comprising:

receiving antenna control signals for the plurality of antenna elements, and switching on and off each of the plurality of antenna elements based on the antenna control signals.

13. The method of claim 10, further comprising:

receiving first phase control signals for first beam former components in the plurality of antenna elements and second phase control signals for second beam former components in the plurality of antennae elements;

switching, according to the first phase control signals, the first beam former components to steer a first antenna beam in a first direction; and switching, according to the second phase control signals, the second beam former components to steer a second antenna beam in a second direction.

14. The method of claim 10, further comprising:

switching the one set of antenna elements that forms a hexagonal array to a first phase shift state and the other set of antenna elements to a second phase shift state of the plurality of phase shift states to steer the antenna beam.

15. The method of claim 10, further comprising:

controlling at least one of transistor switches and MEM switches to switch each of the plurality of antenna elements to one of the plurality of phase shift states based on the phase control signals.

16. A spacecraft, comprising:

an antenna array system that includes:

a plurality of antenna elements organized in an array and configured to form a non-planar shaped antenna array surface, each of the plurality of antenna elements being switchable to one of a plurality of phase shift states; and phase-shift switching circuitry configured to switch one set of the antenna elements to one of the phase shift states and switch another set of the antenna elements to another of the phase shift states based on phase control signals for steering an antenna beam to a direction, the one set and another set being one and another of at least four sets of the antenna elements, a first set having a phase delay range of (−45°,+45°), a second set having a phase delay range of (+45°,+135°), a third set having a phase delay range of (+135°,+225°), and a fourth set having a phase delay range of (+225°,+315°).

17. The spacecraft of claim 16, wherein each of the plurality of antenna elements is switchable to one of 0° phase shift state, 90° phase shift state, 180° phase shift state and 270° phase shift state.

18. The spacecraft of claim 16, wherein the antenna array system further includes:

antenna switching circuitry configured to switch on or off each of the plurality of antenna elements based on antenna control signals.

19. The spacecraft of claim 16, wherein each of the antenna elements includes at least two beam former components that are individually switchable to the plurality of phase shift states.

20. The spacecraft of claim 16, wherein the one set of antenna elements forms a hexagonal array.

* * * * *